US007278182B2

(12) United States Patent
Wu

(10) Patent No.: US 7,278,182 B2
(45) Date of Patent: Oct. 9, 2007

(54) HANDLE STRUCTURE

(76) Inventor: Chen-Chuan Wu, No. 9-3, Wuguan 1st Rd., Xinzhuang City, Taipei County 242 (TW)

( * ) Notice: Subject to any disclaimer, the term of this patent is extended or adjusted under 35 U.S.C. 154(b) by 219 days.

(21) Appl. No.: 11/066,143

(22) Filed: Feb. 25, 2005

(65) Prior Publication Data

US 2006/0191103 A1 Aug. 31, 2006

(51) Int. Cl.
*B25G 1/04* (2006.01)

(52) U.S. Cl. ..... 16/113.1; 16/431

(58) Field of Classification Search ..... 16/113.1, 16/114.1, 444, 430, 431; 81/489, 492, 177.1; 294/25, 57, 137, 171; 190/115, 18 A
See application file for complete search history.

(56) References Cited

U.S. PATENT DOCUMENTS

| | | | | | |
|---|---|---|---|---|---|
| 2,274,605 | A * | 2/1942 | Hoffmeister | 16/411 |
| 2,913,080 | A * | 11/1959 | Louik et al. | 16/408 |
| 2,987,149 | A * | 6/1961 | Finkelstein | 16/408 |
| 3,023,868 | A * | 3/1962 | Koffler | 16/114.1 |
| 3,500,973 | A * | 3/1970 | Bush | 16/114.1 |
| 3,692,155 | A * | 9/1972 | Laurita | 16/114.1 |
| 4,261,078 | A * | 4/1981 | Edwards et al. | 16/409 |
| 4,340,990 | A * | 7/1982 | Seynhaeve | 16/445 |
| 4,364,150 | A * | 12/1982 | Remington | 16/409 |
| 6,119,309 | A * | 9/2000 | Lu | 16/114.1 |
| 6,167,592 | B1 * | 1/2001 | Tsai | 16/411 |
| 6,826,804 | B2 * | 12/2004 | Zaidman | 16/436 |
| 2004/0010887 | A1 * | 1/2004 | Cohen | 16/431 |

FOREIGN PATENT DOCUMENTS

| | | | |
|---|---|---|---|
| DE | 2828705 | A * | 1/1980 |
| DE | 3248509 | A1 * | 8/1984 |
| FR | 2257240 | A * | 9/1975 |
| FR | 2467677 | A * | 5/1981 |
| WO | WO 200108528 | A1 * | 2/2001 |

* cited by examiner

*Primary Examiner*—Chuck Y. Mah

(57) ABSTRACT

The handle structure includes a main body and a gripping device. The gripping device is disposed on the bottom of the main body, including an outer layer and a soft member layer. The outer layer covers the soft member layer, and the soft member layer is a soft rubber, thereby providing the better gripping stability, the comfortable feeling, and the gripping quality by the soft member layer and the outer cover layer, in order to reduce the uncomfortable feeling on hand.

14 Claims, 5 Drawing Sheets

HANDLE STRUCTURE

BACKGROUND OF THE INVENTION

1. Field of the Invention

The present invention relates to a handle structure, and more specifically, to a handle structure which provides the better gripping stability, the comfortable feeling, and the gripping quality.

2. Description of the Related Art

Conventional handle for a suitcase, a vacuum cleaner, an electric fan or the like generally includes a solid portion with a leather outer sleeve. The users may not feel comfortable when the luggage device or the suitcase is heavy. Although the handle must be rigid, there is usually not a significant load-bearing requirement for handles used for suitcase. Additionally, unlike handles for luggage, the comfort of the user when operating the handle has not previously been a primary consideration for the design of luggage handles. In this regard, users sometime experience an unpleasant sensation about slipping off the hand, resulting in the pressure reaction on the hand.

In view of this, the present invention provides a handle structure to overcome the above-mentioned disadvantages.

SUMMARY OF THE INVENTION

The present invention provides a handle structure which is comfortable in the hand of the user and provides the user with a good grip, in order to overcome the disadvantage of slipping off the hand of the user.

The present invention further provides a handle structure which has the better gripping feeling on the hand of the user, in order to increase the additional value and the market competition.

According to a preferred embodiment of the present invention, a handle structure is provided, comprising a gripping device. The gripping device is disposed on the bottom of a main body, comprising an outer layer and a soft member layer. The outer layer covers the soft member layer, and the soft member layer is a soft rubber.

The objectives of the present invention will become obvious to those of ordinary skill in the art after reading the following detailed description of the preferred embodiment.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

Figure 1:
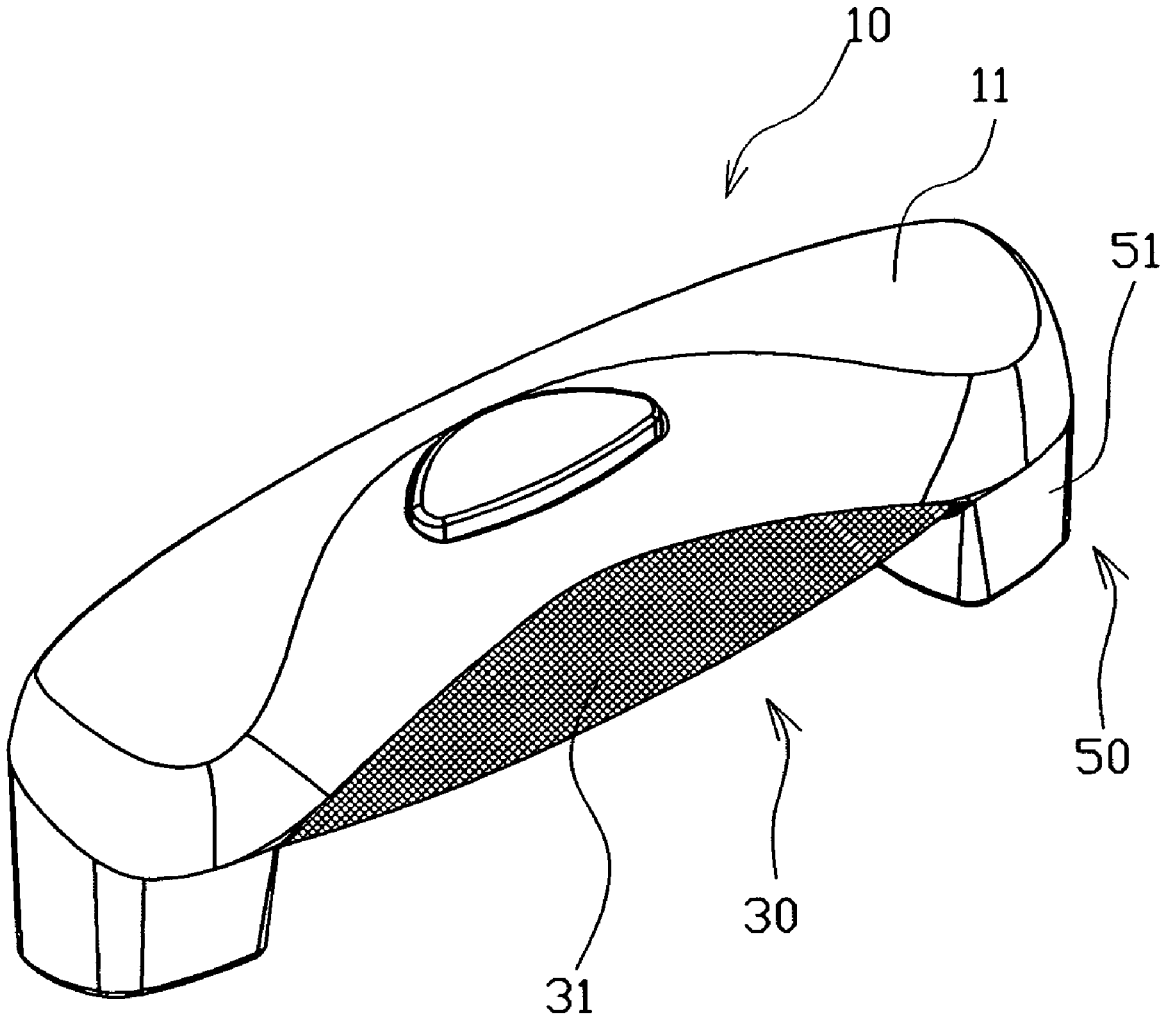
FIG. 1 is a perspective view of a handle structure according to a first preferred embodiment of the present invention.
Figure 2:
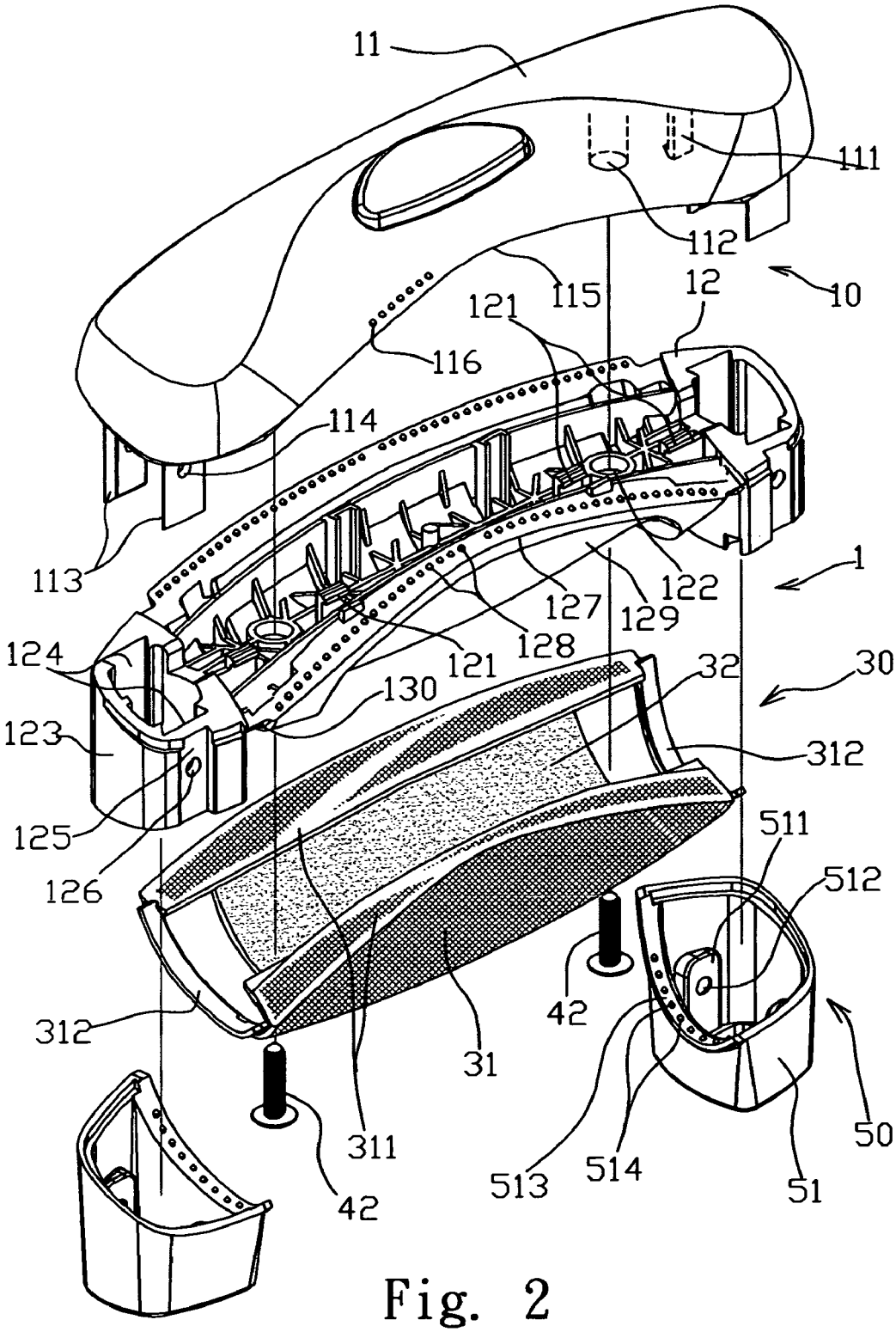
FIG. 2 is an exploded view of a handle structure according to a first preferred embodiment of the present invention.
Figure 3:
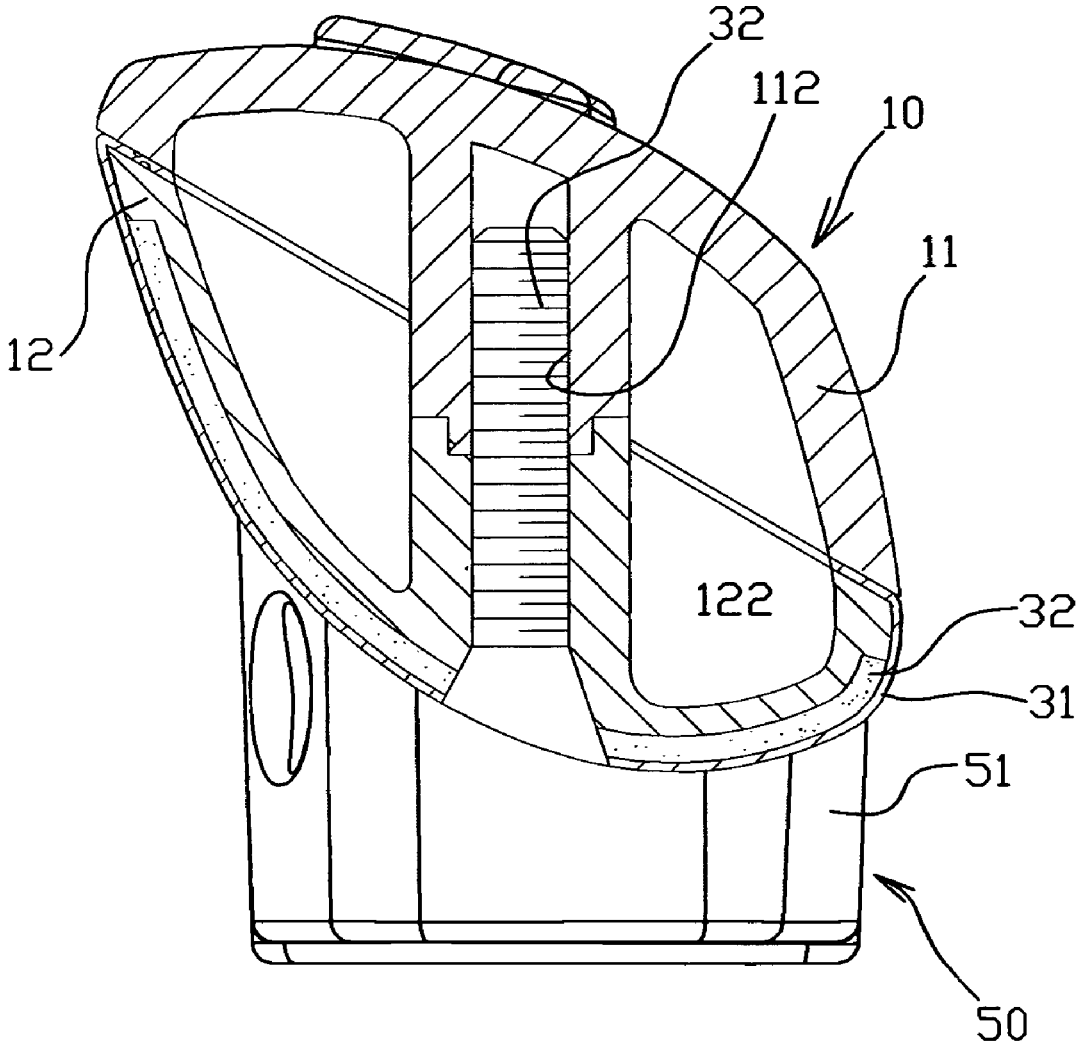
FIG. 3 is an assembly view showing a handle structure according to a first preferred embodiment of the present invention.
Figure 4A:
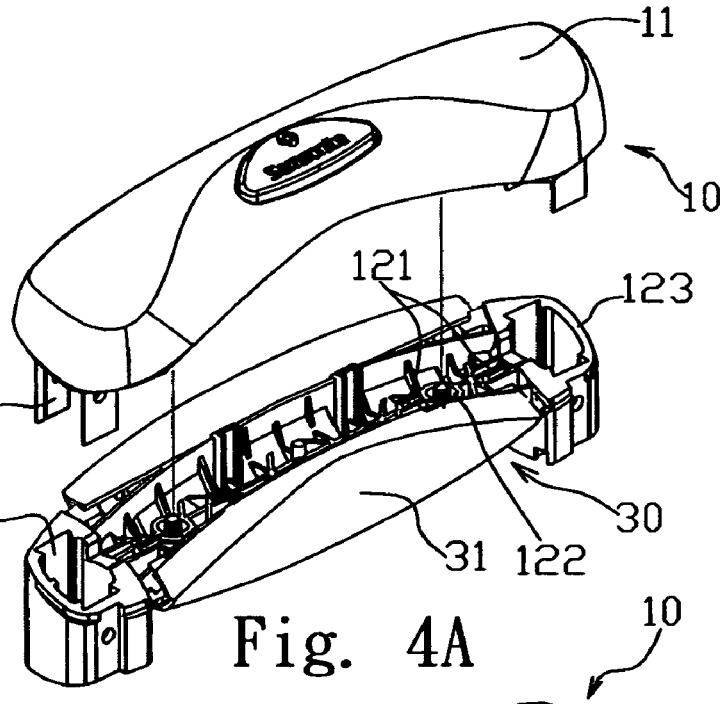
FIG. 4A is a partial perspective view of a handle structure according to a first preferred embodiment of the present invention.
Figure 4C:
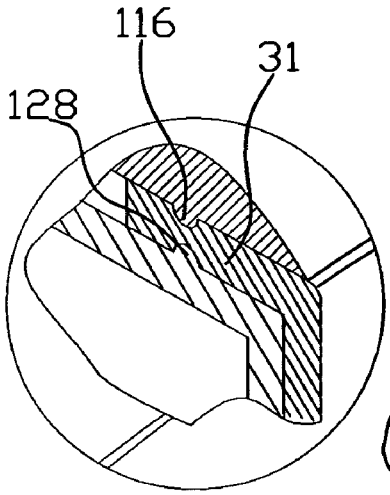
FIG. 4C is a partially enlarged view of a handle device according to a first preferred embodiment of the present invention.
Figure 4B:
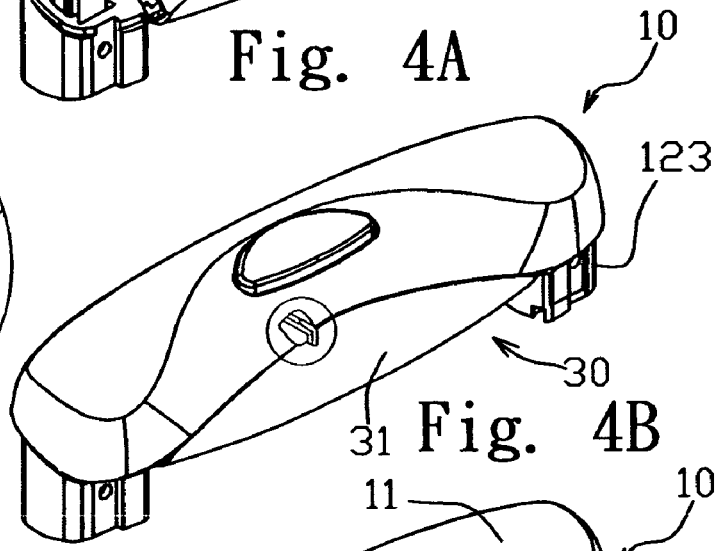
FIG. 4B is an assembly view showing a handle structure according to a first preferred embodiment of the present invention.
Figure 4D:
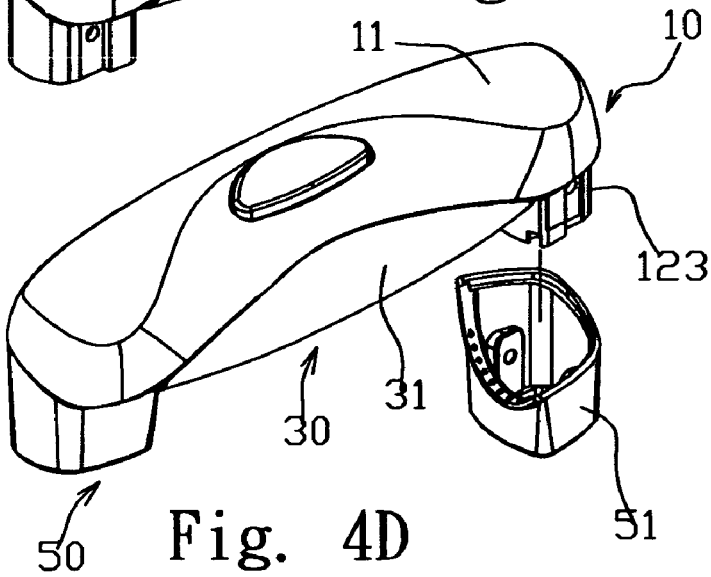
FIG. 4D is an assembly view showing a cover device according to a first preferred embodiment of the present invention.

Please refer to FIGS. 1, 2 and 3, a handle structure is shown. A handle structure of the baggage illustrates the preferred embodiment of the present invention. The handle 1 comprises a main body 10, a gripping device 30 and a cover device 50. The main body 10 comprises an upper housing 11 and a lower housing 12. A plurality of hooked plates 111 and tapped holes 112 are mounted inside the upper housing 11. Two ends of the upper housing 11 extend downwardly to form two pairs of embedded plates 113. A plurality of fixed holes are mounted on the embedded plates 113. A plurality of fixed bumps 116 are disposed on two sides 115 of the gripping portion on the upper housing 11. A plurality of hooked plates 121 and tapped holes 122 are mounted inside the lower housing 12 correspondingly to the upper housing 11. Two sockets 123 are respectively formed on two ends of the lower housing 12. The socket 123 comprises an inner embedded groove 124, an outer embedded groove 125 and a through hole 126. A plurality of fixed bumps 128 are disposed on two sides 127 of the gripping portion on the lower housing 12. An arc notch 129 and a side groove 130 are formed on the bottom of the lower housing 12.

The gripping device 30 is disposed on the bottom of the main body or other properly position. The gripping device 30 comprises an outer cover layer 31 and a soft member layer 32. The outer cover layer 31 is formed of soft material, such as a soft cloth. The soft member layer 32 is a soft rubber, such as silica or TPR (thermal Plastic Rubber). The soft member layer 32 is disposed inside the outer cover layer 31, and covered by the outer cover layer 31.

The cover device 50 comprises two cover housings 51. A pair of bumps 511 is formed inside the cover housing 51. The bump 511 comprises 512 a protruding portion 512. The portion 513 is formed on inner side of the cover housing 51. A plurality of fixed bumps 514 are formed on the side portion 513.

Refer to FIGS. 4A, 4B, 4C, 4D, when assembling the handle of the present invention, the soft member layer 32 is attached in the arc notch 129 on the bottom of the lower housing 12 by coating the adhesive agent. The bend side 311 on the outer cover layer 31 is attached to one side 127 of the lower housing 12. The bend end 312 on the outer cover layer 31 is attached to one side groove 130 of the lower housing 12. While continuing to assemble with the upper housing 11 and lower housing 12, the embedded plate 113 of the upper housing 11 inserts into the inner embedded groove 124 of the lower housing 12, thereby engaging with the hooked plate 111 of the upper housing 11 and the hooked plates 121 of the lower housing 12 to integrate together. Meantime, the engagement of the upper housing 11 and the lower housing 12 makes that the bend side 311 further engages with the fixed bumps 116 and 128. In this preferred embodiment of the present invention, the outer cover layer 31 is fastened on the tapped hole 112 of the upper housing 11 and the tapped hole 122 of the lower housing 12 by the screw bolt 42 in order to increase the stability of the engagement, as shown in FIG. 3.

The cover housing 51 continuously assembles on the socket 123 of the lower housing 12. The bump 511 of the cover housing 51 embeds into the embedded groove 125 of the lower housing 12, thereby covering the bend end 312 of the outer cover layer 31 by the side portion 513 of the cover housing 51. The fixed bump 514 on the side portion 513 further engages the bend end 312 of the outer cover layer 31.

Figure 5:
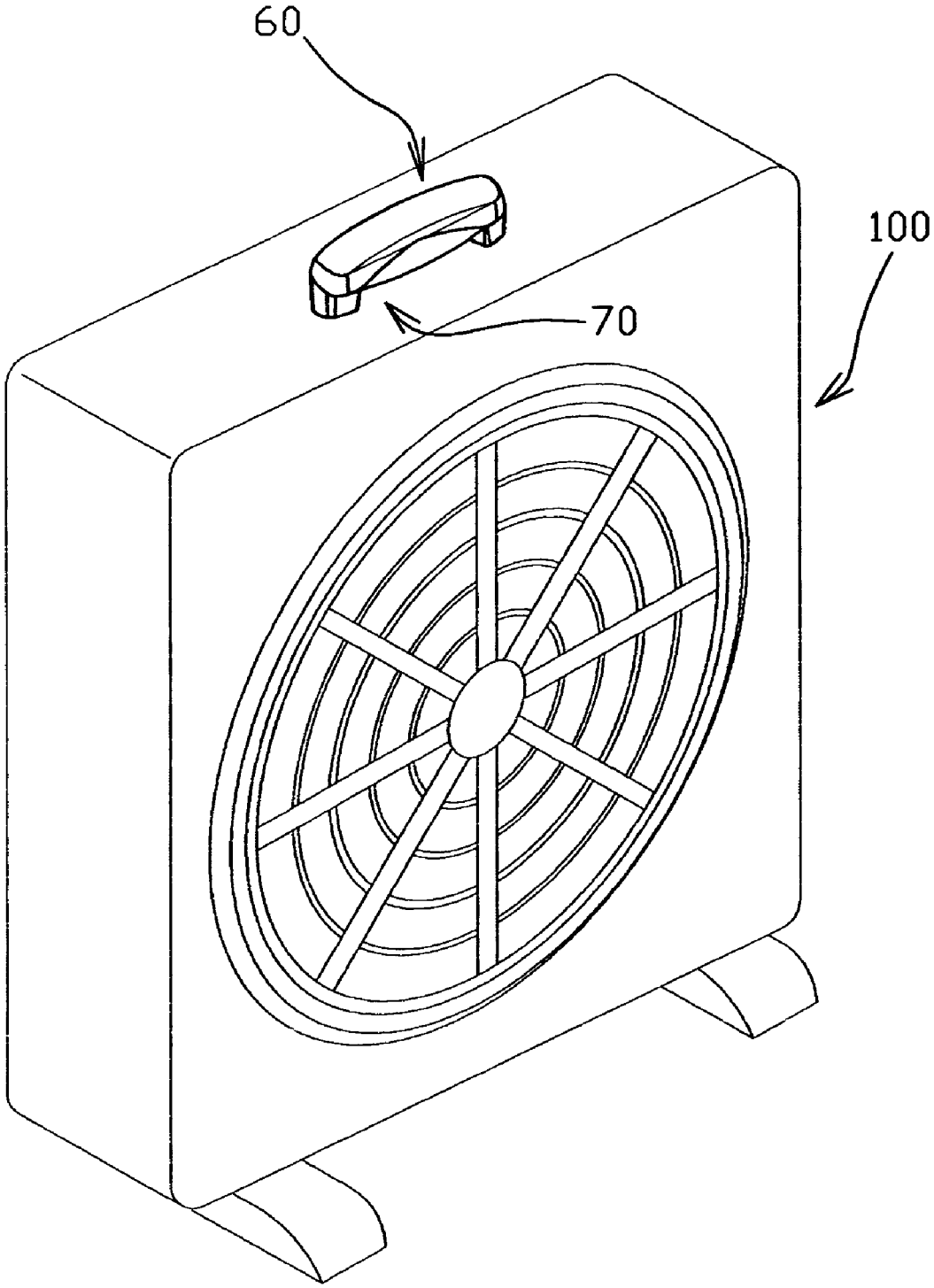
FIG. 5 is a perspective view of a handle structure according to a second preferred embodiment of the present invention.

Refer to FIG. 5, a second preferred embodiment of the present invention is shown. A main body 60 is disposed on an electric fan 100. The bottom of the main body 60 comprises a gripping device 70. The structure of the gripping device 70 is shown as the first embodiment.

According to the present invention, a gripping device is disposed on the main body, thereby providing the better gripping stability, the comfortable feeling, and the gripping quality by the soft member layer and the outer cover layer, in order to reduce the uncomfortable feeling on hard.

The embodiment above is only intended to illustrate the present invention; it does not, however, to limit the present invention to the specific embodiment. Accordingly, various modifications and changes may be made without departing from the spirit and scope of the present invention as described in the following claims.

What is claimed is:

1. A handle structure, comprising:

a main body;

a gripping device disposed on the bottom of the main body, comprising an outer cover layer and a soft member layer, wherein the outer cover layer covers the soft member layer, and the soft member layer is a soft rubber; and at least one cover housing, and a side portion formed on inner side of the cover housing for covering a bending side of the outer cover layer, a plurality of fixed bumps being formed on the side portion, wherein an arc notch is formed on the bottom of the main body for receiving the soft member layer, and wherein a side groove is formed on the bottom of the main body for receiving a bend end of the outer cover layer.

2. The handle structure of claim 1, wherein the soft member layer is silica or TPR (thermal Plastic Rubber).

3. The handle structure of claim 1, wherein the outer cover layer and the soft member layer are fixedly attached to the main body.

4. The handle structure of claim 1, wherein the outer cover layer is fastened on the main body by a screw bolt.

5. A handle structure, comprising:

a main body having an upper housing and a lower housing to be engaged each other; and a gripping device disposed on the bottom of the lower housing, comprising an outer cover layer and a soft member layer, wherein the outer cover layer covers the soft member layer, and the soft member layer is a soft rubber, wherein a plurality of hooked plates and tapped holes are mounted inside the upper housing and the lower housing.

6. The handle structure of claim 5, wherein the upper housing and the lower housing comprise sides, and a plurality of fixed bumps are disposed on the sides for engaging the outer cover layer.

7. The handle structure of claim 5, wherein an arc notch is formed on the bottom of the lower housing for receiving the soft member layer.

8. The handle structure of claim 5, wherein a side groove is formed on the bottom of the lower housing for receiving the outer cover layer.

9. The handle structure of claim 8, further comprising at least one cover housing, and a side portion formed on inner side of the cover housing for covering a bending side of the outer cover layer.

10. The handle structure of claim 9, wherein a plurality of fixed bumps are formed on the side portion of the cover housing.

11. The handle structure of claim 5, wherein the soft member layer is silica or TPR (thermal Plastic Rubber).

12. The handle structure of claim 5, wherein the outer cover layer and the soft member layer are fixedly attached to the lower housing.

13. The handle structure of claim 5, wherein the outer cover layer is fastened on the tapped holes of the lower housing by the screw bolts.

14. A handle structure, comprising:

a main body;

a gripping device disposed on the bottom of the main body, comprising an outer cover layer and a soft member layer, wherein the outer cover layer covers the soft member layer, and the soft member layer is a soft rubber, wherein a side groove is formed on the bottom of the main body for receiving the outer cover layer; and at least one cover housing with a side portion formed on an inner side thereof for covering a bending side of the outer cover layer, wherein a plurality of fixed bumps are formed on the side portion.

* * * * *